United States Patent [19]

Williamson

[11] 3,943,375

[45] Mar. 9, 1976

[54] ON-OFF SWITCH WITH TIME DELAY

[75] Inventor: David V. Williamson, Danvers, Mass.

[73] Assignee: GTE Sylvania Incorporated, Danvers, Mass.

[22] Filed: Dec. 23, 1974

[21] Appl. No.: 535,463

[52] U.S. Cl. ..... 307/141; 338/22 R; 315/360

[51] Int. Cl.[2] ..... H01H 7/00

[58] Field of Search ..... 307/141, 141.4, 141.8, 307/10 BP, 10 LS; 315/360, 119, 127, 128, 8, 83, 71; 49/504, 505; 219/504, 505; 338/22 R, 25, 13

[56] References Cited

UNITED STATES PATENTS

| | | | |
|---|---|---|---|
| 3,028,525 | 4/1962 | Morton | 315/71 X |
| 3,243,753 | 3/1966 | Kohler | 219/504 |
| 3,544,838 | 12/1970 | Carruth et al. | 315/83 |

*Primary Examiner*—Robert K. Schaefer
*Assistant Examiner*—M. Ginsburg
*Attorney, Agent, or Firm*—Edward J. Coleman

[57] ABSTRACT

An on-off switch having a time delayed "off" position provided by a series-connected PTC thermistor.

8 Claims, 1 Drawing Figure

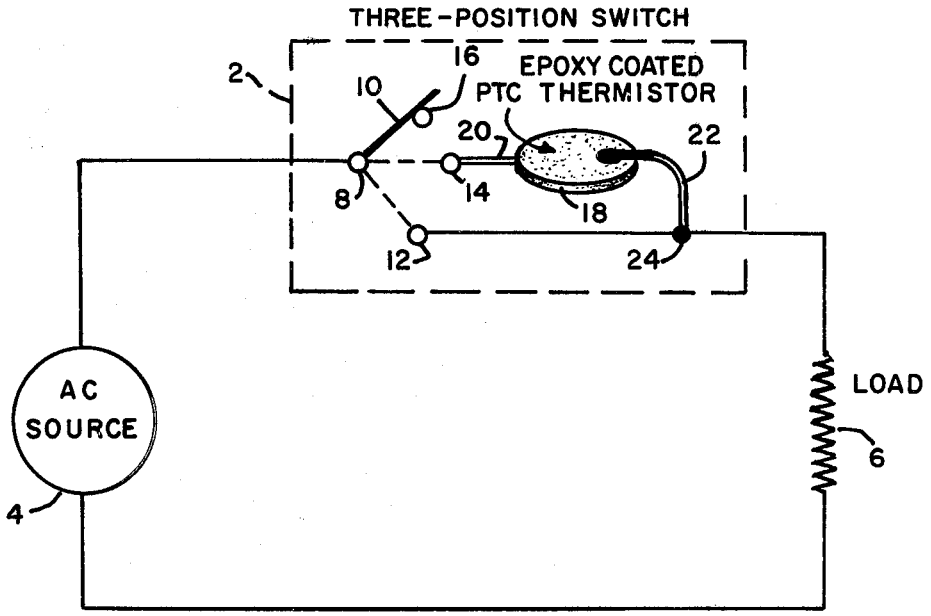
THREE-POSITION SWITCH
EPOXY COATED
PTC THERMISTOR
2
10
16
20
22
8
14
18
12
24
AC
SOURCE
4
LOAD
6

ON-OFF SWITCH WITH TIME DELAY

BACKGROUND OF THE INVENTION

This invention relates to electrical circuit switches and more particularly to residential wall-mounted light switches.

Such switches typically comprise single-pole double-throw switches connected as the sole on-off control for a room lighting circuit, or as a pair of on-off switches connected in a three-way arrangement at two locations. Although widely used, these common on-off switches can pose a considerable inconvenience and even create a hazardous condition in certain applications. For example, consider a person awkwardly attempting to get into bed in the dark after turning off a bedroom wall switch, or walking through a darkened machine shop toward an exit after turning off a remote light-switch, or entering a car and driving out of a garage at night after switching off the lights.

SUMMARY OF THE INVENTION

In view of the foregoing, it is an object of this invention to provide an improved switch for electrical circuits.

A particular object is to provide a light-switch having a delayed "off" function which is adapted for compact, low cost packaging in a unit interchangeable with conventional on-off switches.

These and other objects, advantages and features are attained, in accordance with the invention, by providing a switch position having a positive-temperature-coefficient (PTC) thermistor series connected therewith, the thermistor being selected to delay deenergization of the switch circuit for a predetermined period of time upon actuation from the "on" position to said thermistor position, whereby a time delayed off function is provided.

BRIEF DESCRIPTION OF THE DRAWING

This invention will be more fully described hereinafter in conjunction with the accompanying drawing, the single FIGURE of which is a schematic diagram of a circuit including a three-position switch with a PTC thermistor connection in accordance with the invention, the thermistor being illustrated in perspective.

DESCRIPTION OF PREFERRED EMBODIMENT

Referring to the drawing, a three-position switch 2, in accordance with the invention, is shown connected in a simple AC circuit arrangement including an AC source 4, which may typically comprise a 60 cycle, 120 volt supply, and a load 6, which may be representative of lamps, light fixtures, appliances, etc. The load 6 and switch 2 are series-connected in circuit across the AC source 4.

Switch 2 basically may comprise a single-pole double-throw wall switch with an off position and be adapted for residential lighting circuits. The switch has a common terminal 8 adapted for connection to the circuit, a selective switching means 10 connected to the common terminal 8, and first, second and third position contacts 12, 14 and 16, respectively; for selective engagement by the switching means 10. Position contact 12 is adapted for connection to the circuit whereby, upon engagement by the switching means 10 (as indicated by the dashed line between terminal 8 and contact 12), a closed circuit on condition can be provided; i.e., the load 6 will be fully energized. In the drawing, common terminal 8 is connected to the AC source 4 and contact 12 is connected to load 6.

Position contact 16, as indicated, is an open circuit contact whereby upon engagement by switching means 10, an off condition is provided, i.e., the load 6 is not energized.

In accordance with the invention, the switch further includes a positive-temperature-coefficient (PTC) thermistor 18 connected between position contacts 14 and 12. For example, as illustrated, the body of thermistor 18, typically a semiconductor composition coated with epoxy, may be formed in a disc-type configuration, with a pair of lead wires 20 and 22 electrically attached to opposite flat sides of the disc. One lead wire 20 is electrically connected to the contact 14, while the other lead wire 22 may be connected to a terminal post 24 to which contact 12 is connected, terminal post 24 then being connected to load 6 in the circuit arrangement.

To consider operation of the PTC thermistor arrangement, assume that switch 2 is connected in the circuit shown and that the switching means 10 has been actuated from position contact 12 (the closed circuit on condition) to position contact 14 (as indicated by the dashed lines between terminal 8 and contact 14). In this position, PTC thermistor 18 is series-connected with the closed switch in the circuit, and load current flows through the device. The PTC thermistor is selected to have a relatively low zero-power (cold) resistance, e.g., about 27 ohms at 25°C. When current passes through the device, resistance heating occurs until the PTC switching temperature is reached. Then the resistance increases sharply and the disc body 18 becomes heated rapidly to an equilibrium condition.

The resistance versus temperature characteristic of the typical PTC device shows a somewhat negative slope as the temperature initially rises from the "cold" condition. Then at a given temperature region, the device ideally switches from a semiconductive state to that of an insulator, and the resistance rises sharply over a very narrow temperature range. A selected temperature in this switching region is referred to as the switching temperature of the thermistor. As the resistance versus temperature slope is sharply positive in this region, the thermistor will have a substantially stabilized body temperature at approximately the rated switching temperature of the device. A PTC thermistor selected to have a switching temperature of 60°C is particularly suitable for the present application.

Assuming that load 6 comprises lamps and/or light fixtures, and that the switching means 10 has been actuated from contact 12 to contact 14, the illumination level provided by the lighting system load will remain at substantially the same level (with some diminution due to the resistance of the thermistor as it heats up) until the PTC thermistor 18 is heated to its switching temperature, whereupon in the period of a second or two the circuit will be deenergized, except for a trickle of current which continues to pass through the circuit to keep the thermistor heated and, thus, maintain its state as an insulator. In this manner, the second switch position provides a time delayed off function.

The time to thermistor switching and, thus, the period of time by which deenergization of the circuit is delayed, upon actuation of the switching means from contact 12 to contact 14, may be substantially predetermined by appropriate selection of thermistor characteristics. For example, the delay time (switch time) can be extended by selecting either a higher switching temperature or a lower zero-power resistance. Further, the delay time can also be extended by increasing the mass of the device to extend the heat-up time; for example, the mass may be increased by encapsulating or coating the device in an insulating material, such as epoxy. Of course, in this application an insulating coating is desirable for safety purposes in any event.

According to one specific embodiment, switch 2 was connected in a circuit having a 60 cycle, 120 volt AC source and a 75 watt light bulb as load 6. PTC thermistor 18 was of the epoxy coated disc-type and selected to have a zero-power resistance of about 27 ohms at 25°C, a voltage rating of up to 132 volts AC, and a switching temperature of 60°C. Upon switching from contact 12 to contact 14, the thermistor controlled the time delay function of the switch so that the 75 watt light bulb was turned off in about seven seconds. That is, it took the thermistor about 7 seconds to heat up to the switching temperature (60°C); thereafter, the light was essentially extinguished in about one second.

Although the invention has been described with respect to specific embodiments, it will be appreciated that modifications and changes may be made by those skilled in the art without departing from the true spirit and scope of the invention. For example, it is clear that the invention is not limited to the illustrated three-position switch, as the thermistor arrangement may be employed in other switch types, such as a switch having only two positions, namely, an on position and a time delayed off position.

What I claim is:

1. A switch for an electrical circuit, said switch comprising: a common terminal adapted for connection to said circuit; selective switching means connected to said common terminal; at least first and second position contacts for selective engagement by said switching means, said first position contact being adapted for connecting to said circuit whereby upon engagement by said switching means a closed-circuit on condition can be provided; and a positive-temperature-coefficient thermistor connected between said second and first position contacts whereby, upon connection of said switch in said circuit and engagement of said second position contact by said switching means, said thermistor is series connected with said switch in said circuit; said thermistor being selected to delay deenergization of said circuit for a predetermined period of time upon actuation of said switching means from said first to said second position contact whereby a time delayed off function is provided.

2. The switch of claim 1 further including a third position contact for selective engagement by said switching means, said third position contact being an open circuit contact whereby upon engagement by said switching means on off condition can be provided.

3. The combination of claim 2 wherein said switch comprises a single-pole double-throw wall switch with an off position and is adapted for residential lighting circuits.

4. The switch of claim 1 wherein said delay time is substantially predetermined by selection of the zero-power resistance and switching temperature of said thermistor.

5. The switch of claim 4 wherein said thermistor is encapsulated in an insulating material, the mass of which is selected to extend the heat-up time of said thermistor, when energized, to thereby extend said delay time.

6. The switch of claim 1 wherein the switching temperature of said thermistor is approximately 60°C.

7. The switch of claim 6 wherein the zero power resistance of said thermistor at 25°C is about 27 ohms, and said thermistor has a voltage rating of up to 132 volts AC.

8. The switch of claim 7 wherein said thermistor is of a disc-type configuration and is epoxy coated.

* * * * *